US008997891B2

(12) United States Patent
Schauerte

(10) Patent No.: US 8,997,891 B2
(45) Date of Patent: Apr. 7, 2015

(54) EARTH BORING APPARATUS

(75) Inventor: Thomas Schauerte, Lennestadt (DE)

(73) Assignee: Tracto-Technik GmbH & Co. KG, Lennestadt (DE)

( * ) Notice: Subject to any disclaimer, the term of this patent is extended or adjusted under 35 U.S.C. 154(b) by 813 days.

(21) Appl. No.: 13/101,637

(22) Filed: May 5, 2011

(65) Prior Publication Data

US 2012/0111634 A1 May 10, 2012

(30) Foreign Application Priority Data

May 6, 2010 (DE) ..... 10 2010 019 514

(51) Int. Cl.
*E21B 17/00* (2006.01)
*E21B 7/04* (2006.01)

(52) U.S. Cl.
CPC ..... *E21B 7/046* (2013.01); *E21B 17/003* (2013.01)

(58) Field of Classification Search
CPC ..... E21B 17/003; E21B 17/028; E21B 41/02
USPC ..... 166/380, 65.1; 175/57
See application file for complete search history.

(56) References Cited

U.S. PATENT DOCUMENTS

| | | | | |
|---|---|---|---|---|
| 4,466,484 | A * | 8/1984 | Kermabon | 166/60 |
| 6,131,657 | A | 10/2000 | Keatch | |
| 2001/0012703 | A1 | 8/2001 | Wurm et al. | |
| 2002/0014334 | A1 | 2/2002 | Chau et al. | |
| 2003/0082929 | A1 | 5/2003 | Wurm et al. | |

FOREIGN PATENT DOCUMENTS

| | | | |
|---|---|---|---|
| DE | 198 19 626 | A1 | 4/1999 |
| DE | 698 21 665 | T2 | 12/2004 |
| JP | 63-14209 | * | 1/1988 |
| WO | WO 95/22679 | | 8/1995 |

* cited by examiner

*Primary Examiner* — David Andrews
(74) *Attorney, Agent, or Firm* — Howard IP Law Group, PC

(57) ABSTRACT

An earth boring apparatus includes a drill rod, a source for a drill fluid, and a voltage source. The drill rod has a hollow rod casing provided for throughflow of the drill fluid, and a conductor located within the rod casing, with the voltage source being connected with the conductor and the rod casing. The voltage source is so connected as to prevent the electric conductor to act as anode in the event the drill fluid establishes an electrically conductive connection between the rod casing and the conductor.

19 Claims, 2 Drawing Sheets

EARTH BORING APPARATUS

CROSS-REFERENCES TO RELATED APPLICATIONS

This application claims the priority of German Patent Application, Serial No. 10 2010 019 514.6, filed May 6, 2010, pursuant to 35 C. 119(a)-(d), the content of which is incorporated herein by reference in its entirety as if fully set forth herein.

BACKGROUND OF THE INVENTION

The present invention relates to an earth boring apparatus, and to a drill rod for use in such an earth boring apparatus.

The following discussion of related art is provided to assist the reader in understanding the advantages of the invention, and is not to be construed as an admission that this related art is prior art to this invention.

The introduction of boreholes in the ground is implemented by boring apparatuses having a drill head arranged on a drill rod on the front side and propelled into the ground by means of the drill rod. The pressure forces required for the propulsion are hereby applied by a driving device which is arranged above ground or an excavation pit near the ground surface. In general, the drill head—in addition to the pressure forces—is simultaneously caused to rotate, with the rotation being produced either by a down-the-hole motor, a motor which is arranged in the area of the drill head and transmits the rotation movement only to the front of the drill head, or also by the driving device arranged on the surface or in the excavation pit, with the rotation movement again being transmitted by the drill rod.

In particular, when producing horizontal boreholes, which normally are realized starting from a defined surface-near starting point to a surface-near destination point which is also defined beforehand, it is required to permanently monitor the course of the borehole in order to undertake a correction, if need be, when encountering an excessive deviation from the previously determined desired course. Controllable horizontal boring apparatuses have been developed for this purpose.

The supervision of the drilling course requires a localization of the position of the drill head within the earth. A radio transmitter has oftentimes been used which is arranged within the drill head and sends out radio signals which are received by a receiver unit above ground and analyzed for determining the position of the drill head. The radio transmitter has to receive electric energy for this purpose. This may be realized using batteries which are also arranged in the area of the drill head. The use of batteries as energy sources for the radio transmitters involves however much maintenance because they need to be replaced or charged regularly. This need for maintenance should preferably be avoided. Furthermore, depending on the drilling depth, the earth being bored through, and the type of utilized receiver, fairly strong radio signals must be transmitted which require the availability of a respectively powerful energy source. To configure such an energy source in the form of batteries is accompanied with disproportionate economic effort. Because of these disadvantages relating to the use of batteries as an energy source for the radio transmitter, arranged in the drill head, the provision of an external energy source, i.e. above ground, is proposed. Oftentimes, this involves a 12 volt or 24 volt battery by which primarily the boring drive and/or a control device of the earth boring apparatus is supplied. The electrical energy must then be transmitted between the external energy source and the radio transmitter by normally using an electrical conductor (cable or cable string) installed within the drill rod.

Such an electrical conductor can simultaneously also be used for transmitting signals from sensors which are arranged in the area of the drill head, to an evaluation unit arranged on the ground surface. For example, in the area of the drill head of a horizontal boring device, rolling sensors, inclination sensors as well as sensors for detecting electromagnetic fields are used as they are emitted by current conductors installed in the earth.

Since the boring lengths of horizontal boreholes can frequently be several hundred meters and the vertical boreholes may sometimes also have lengths of several thousand meters, inevitably drill rods must be used which are composed of individual interconnected rod sections. In accordance with the advance of the borehole, the individual rod sections are successively attached to the already existing boring string.

In dependence on the earth layers to be bored through, it is further normally necessary to assist the boring propulsion by applying a drill fluid. The drill fluid primarily has the purpose of lubricating the drill head, to soften the earth in front of the drill head, and thereby to improve the boring propulsion and to flush out the borings removed by the drill head through the annular space formed by the drill rod and the borehole wall. The drill fluid, which as a rule is fed to the drill head through the interior space of the hollow drill rod, is discharged through outlet openings in the area of the drill head. As drill fluid an aqueous solution of bentonite and possibly additional additives has been found useful in practice. Such a bentonite drill fluid has a pH-value of less than 7, i.e., it behaves chemically like an acid. Moreover, drill fluids and especially bentonite drill fluids are more or less electrically conductive, wherein the electrical conductivity and the charge transport are effected by the directional movement of ions. Consequently, the drill fluids are electrolytic.

The placement and connection of a new rod section to the existing drill string is usually carried out by machines to keep the time expended within limits. However, this is problematic when an electric conductor extends within the drill string for supplying a radio transmitter, arranged in the drill head, with electrical energy or for transmitting the signals from the sensors, arranged in the area of the drill head, to an evaluation unit arranged above ground. In order to make it unnecessary to thread the individual rod sections onto a cable of a length corresponding to the intended drill course, it is normally provided to implement the electrical conductor in the manner of a string, i.e., to progressively extend the conductor through attachment of a new segment. This has the result that each time a new rod section is to be attached and connected to the drill string, initially an appropriate segment of the electrical conductor must be connected to the then free end of the conductor string arranged within the already bored drill string. This is very time-consuming because normally there is not only the need to establish the contact between the last segment of the conductor string and the new conductor segment, but the connection point must also be sealed in a watertight manner (insulated) in order to prevent the electrically conductive drilling mud from causing an electric shorting between the conductor and the rod casing of the drill rod serving as return conductor. In view of the ohmic resistance of the drill fluid which is very high in relation to the electrical conductor and the rod casing of the drill rod, such an electrical shorting leads in the case of an incorrect sealing normally only to more or less great electrical losses, but not to a failure of the energy supply or signal transmission. However, in the event the contact points are leaky there may be the problem in the long run that an electrolysis takes place as a result of the short circuit which is accompanied by corresponding electrolytic reactions at the electrodes, i.e., the non-insulated contact points of the electrical conductor as well as the rod casing of the drill rod. Since the electrical conductor or the non-insulated contact point constitutes an anode charged with a positive voltage potential, an anodic reaction takes place at this anode which is characterized by the deposition of an oxide layer. In contrast thereto, at the cathode, i.e., the rod casing of the drill rod, a cathodic reaction appears as a gas formation.

The anodic reaction at the non-insulated contact points of the electrical conductor poses in the medium and long run a significant problem because the oxidation can deteriorate and possibly completely interrupt the electrical contact between the segments of the conductor so that the energy supply for the radio transmitter or the signal transmission of the sensors of the drill head is no longer operational. Since both functions are necessary for carrying out the boring project, it is necessary in such a case to pull back the drill string step by step and to examine the contact points of the electrical conductor in order to find the faulty location. This is very time-consuming.

It would therefore be desirable and advantageous to provide an improved ground boring apparatus to obviate prior art shortcomings and to prevent the danger of a faulty operation as a result of oxidized contact points of the electrical conductor.

SUMMARY OF THE INVENTION

According to one aspect of the present invention, an earth boring apparatus includes a drill rod having a hollow rod casing constructed for throughflow of a drill fluid, an electrical conductor located within the rod casing, and an electrical voltage source connected to the rod casing and the conductor, said voltage source being connected such that in the event the drill fluid causes an electrically conductive connection between the rod casing and the conductor, the conductor does not act as an anode.

The present invention resolves prior art problems by eliminating in a drill rod of a ground boring apparatus, in which an electrolytic drill fluid is transported between the rod casing of the drill rod and an electrical conductor is located within the rod casing, the risk of an anodic reaction at possibly non-insulated portions of the electrical conductor by producing between the conductor and the rod casing an electrical potential which is established in such a way that in the event the drill fluid causes an electrically conducting connection between the rod casing and the electrical conductor, the conductor does not operate as an anode. This makes it possible that no anodic reaction is established at the electrical conductor. As a result, oxidation of the non-insulated portions of the conductor, as this is known from the prior art, accompanied with the risk of an interruption of the conductivity, can be avoided.

Operation of the electrical conductor as an anode of an electrolytic system comprised of the conductor, the rod casing and the drill fluid can be prevented, on the one hand, by holding the voltage made available by the voltage source below the decomposition voltage of the respectively used drill fluid. If necessary, radio transmitters/sensors may have to be used to permit an operation at such a reduced voltage. The decomposition voltage for conventional drill fluids is between about 1.10 volts and 1.65 volts and thus substantially below the voltage at which radio transmitters/sensors of boring apparatuses are currently operated. Since the composition of the drill fluid is changeable within wide limits so that the level of the decomposition voltage can also change, it may be provided to determine the decomposition voltage of the drill fluid before the respective boring project and to regulate the voltage source to a correspondingly lower value.

Since commercially available radio transmitters and sensors, which can be provided in the drill head of a boring apparatus according to the invention, are intended for operation with voltages which are significantly above the above-mentioned decomposition voltages, an amplifier may be used in the area of the radio transmitters and sensors in order to boost the voltage transmitted via the electrical conductor and the rod casing to the required value. It is also possible to integrate a plurality of amplifiers at defined intervals in the drill rod for compensating a voltage loss which is encountered when electrical energy is transmitted through the electrical conductor and the rod housing. As a result, it is possible that the voltage is not higher than the decomposition voltage over the entire transmission path between the conductor and the rod casing, and, at the same time, to compensate the losses which can occur as a result of the electrical transmission over sometimes several hundred meters so that the radio transmitter/sensors can be supplied with the necessary voltages.

A second possibility for preventing the electrical conductor to operate as an anode of an electrolytic system comprised of the conductor, the rod casing and the drill fluid, may be realized by producing between the conductor and the rod casing an electrical potential in such a way that the electrical conductor acts as cathode and the rod casing acts as anode. In this manner, a cathodic reaction can be established at the non-insulated portions of the electrical conductor, which normally leads only to an essentially harmless gas formation. Oxidation of the non-insulated portions of the conductor, as this is known from the prior art, accompanied with the risk of an interruption of the conductivity of the electrical conductor, can also be prevented. While an anodic reaction does take place at the rod casing of the drill rod, this is, however, largely unproblematic because the inner side of the rod casing is normally subjected directly to the (sometimes very strong) flow of the highly abrasive drill fluid so that the oxide deposits are frequently removed again directly after their creation.

However, even when a removal of oxide deposits does not take place or does not take place fully, this does not normally cause an interruption of the electrical function of the rod casing because the rod casing of the drill rod—contrary to the electrical conductor within the rod casing—has a relatively great conductor cross section so that a transmission of the electrical energy and the signals can be further ensured.

The operation of the electrical conductor as cathode of the electrolytic system can be achieved by applying an electrical potential on the conductor, which is negative in relation to the potential of the rod casing. This can be implemented in various ways. One way would be to use a direct voltage source whose minus pole is connected to the electrical conductor, while the plus pole is connected to the rod casing of the drill rod. Such a procedure may pose a problem in a situation in which for safety reasons the drill rod as well as the voltage source (, typically the energy supply of the drive apparatus) are grounded and, thus are on the same potential (0 volt). A connection of the rod casing operating as electrical return conductor to the plus pole of the voltage source (normally a 12V or 24V battery) would then lead to an electrical short circuit. Therefore, according to another advantageous feature of the present invention, the voltage source may be a negative direct voltage source (i.e., a voltage source which has a negative direct voltage), whose minus pole is connected to the electrical conductor and whose plus pole is connected to a potential on the rod housing corresponding to ground. The use of only a half wave of an alternating voltage as negative voltage source is also possible.

According to another advantageous feature of the present invention, the use of a positive voltage source (i.e., a voltage source which has a positive direct voltage or utilizes only the positive half wave of an alternating voltage) may be provided in spite of a grounding of the drill rod, when the rod casing of the drill rod is constructed of at least two parts, with a first (external) part contacting the ground to thereby ground it, while a second (internal part) comes into contact with the drill fluid and the two parts are insulated relative to each other. The second part of the rod casing can then operate as anode independently from the ground potential of the first layer. The two-part configuration of the rod casing can be realized advantageously by the formation of two casing layers insulated from one another. As an alternative, the second part of the rod casing can be implemented in the form of one or several cable/cables or other electrically conductive bodies which are connected to the first part via an insulation.

To ensure clarity, in the description of the present invention, the term "direct voltage" is to be understood as relating to a voltage which does not change its polarity, while its magnitude may vary however. Consequently, in addition to a constant direct voltage, an also (possibly smoothened) pulsating direct voltage can be used. This direct voltage can be produced by repoling the half waves of an alternating voltage, which are unwanted with respect to the poling.

The configuration of a ground boring apparatus according to the invention may be particularly advantageous when a drill rod is used which is comprised of a plurality of rod sections which are detachably connected to each other, because in such a drill rod it may be useful to construct the electrical conductor installed within the drill rod also in segments which are connectable to each other through couplings. The configuration of a ground boring apparatus according to the invention not only substantially prevents hereby an undesired oxide deposit in the event of poorly insulated connecting points of the segments, but also permits to, optionally completely, eliminate the need for an insulation of the contact points or also of the entire electrical conductor. By omitting an insulation of the individual contact points of the conductor, the time expended and costs can be significantly reduced for the entire boring project. Moreover, by eliminating the need for the insulation of the connecting points of the conductor, the technical effort required for an automated connection of the segments of the electric conductor can additionally significantly be reduced so that manufacturing costs for the ground boring apparatus can be lowered.

An automated connection of the segments of the conductor can preferably be achieved by (positionally) fixing the segments or at least the free ends thereof within the rod sections, so that simultaneously with the connection of the rod sections to each other (for example, by bolting together the rod section ends) a connection of the appropriate segments of the conductor is automatically established. For example, the couplings of the segments can be constructed as plug-in or contact couplings.

According to another aspect of the present invention, a drill rod of an earth boring apparatus includes a hollow rod casing constructed for throughflow of a drill fluid, an electrical conductor located within the rod casing and, when connected to an electrical voltage source, being prevented from acting as an anode in the event the drill fluid causes an electrically conductive connection between the rod casing and the conductor.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

The depicted embodiment is to be understood as illustrative of the invention and not as limiting in any way. It should also be understood that the figure is not necessarily to scale and that the embodiment may be illustrated by graphic symbols, phantom lines, diagrammatic representations and fragmentary views. In certain instances, details which are not necessary for an understanding of the present invention or which render other details difficult to perceive may have been omitted.

Figure 1:
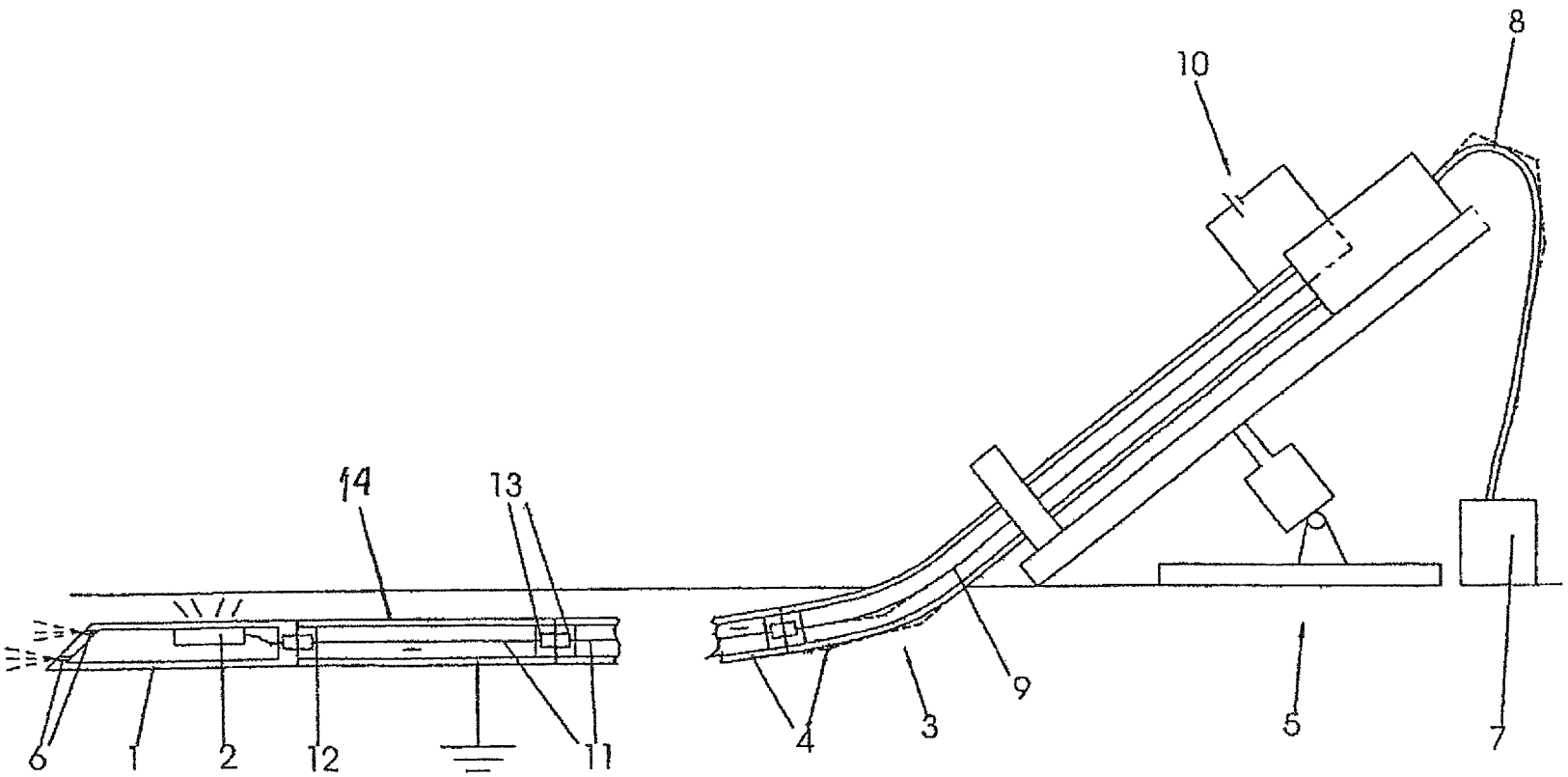
FIG. 1 shows a schematic illustration of a ground boring apparatus according to the invention.
Figure 2:
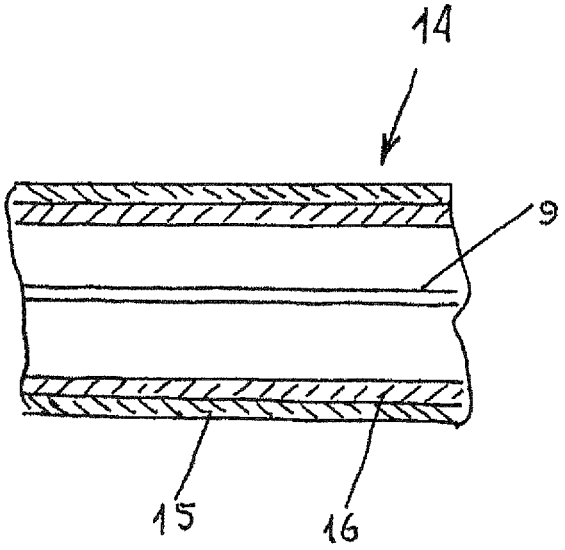
FIG. 2 shows a cross-section of a drill rod casing of the ground boring apparatus of FIG. 1.

Turning now to FIG. 1, there is shown a schematic illustration of a ground boring apparatus according to the invention, generally designated by reference numeral 1. The ground boring apparatus 1 includes a drill head 1 with a hollow space for receiving a radio transmitter 2. The drill head 1 is connected by a drill rod 3 made of a plurality of interconnected (bolted together) rod sections 4 to a boring drive 5 arranged above ground and having a hollow rod casino 14 with a first layer 15 which comes in contact with earth, and a second layer 16 which comes in contact with the drill fluid and is insulated from the first layer 15. The second layer 16 acts as anode (FIG. 2). The boring drive 5 transmits compression forces as well as a torque upon the drill rod 3 and, consequently, also upon the drill head 1 for propelling the drill head 1 in a rotating and pushing manner in the earth. The drill head 1 has a front face provided with several outlet openings 6 through which a drill fluid, which is fed to the drill head 1 through the hollow drill rod 3, is discharged. The drill fluid emanates from a drill fluid source 7 which is connected to the boring drive 5 through a supply line 8 and supplies the drill fluid into the rod casing 14.

The radio transmitter 2 in the drill head 1 of the ground boring apparatus is supplied with electrical energy by an electrical conductor 9 arranged within the drill rod 3. Through a direct contact with the drill head 1, which is made of steel and therefore electrically conductive and which in turn is connected in an electrically conductive manner to the rod sections 4 also made of steel, an electric circuit can be produced by including a voltage source 10.

Since at least individual sections of the drill rod 3 are in continuous contact with the borehole wall, the latter is grounded and thus has a zero-volt potential.

In the same manner as the drill rod 3, the electrical conductor 9 is also constructed in the form of individual segments 11 which are connected to one another. Arranged within each rod section 4 is a segment 11 of the conductor 9, with the two ends of each segment 11 being positionally fixed through suitable holding means 12 in the area of the corresponding ends of the respective rod section 4. Moreover, the ends of each segment include a contact element 13 via which, when two rod sections 4 are bolted together, an electrical connection of the two segments 11 arranged in the rod sections 4 is achieved at the same time by pressing the front contact surfaces of the contact elements 13 against each other.

While the segments 11 of the electrical conductor 9 are themselves electrically insulated, such insulation is not provided for the contact surfaces of the contact elements 13 because the latter must be connected to each other in an electrically conductive manner. Therefore, it may happen that a portion of the contact surfaces comes into contact with the electrically conductive drill fluid which flows around the electrical conductor 9. As a result, an electrical connection is formed by the drill fluid between the two conductors connected to the voltage source 10, i.e., the electrical conductor 9 and the rod casing of the drill rod 3. This leads to an electrolytic reaction of the drill fluid at the exposed contact surfaces or on the inner wall of the drill rod 3.

Since, according to the invention, the electrical potential of the electrical conductor 9 is negative in relation to the potential (0 volt) of the drill rod 3 (achieved by the use of a negative direct current source), a cathodic reaction is established at the conductor 9 (as cathode of the electrolytic system) and characterized by a gas formation. The anodic reaction on the inner wall of the drill rod 3 causes in contrast thereto an oxide formation which is not problematic because the oxides which are being formed there are exposed directly to the flow of the drill fluid and are transported away and flushed out of the drill rod 3. As a result, an oxide formation at the contact surfaces of the contact elements 13 of the segments 11 of the electrical conductor 9, as this is known from the prior art and may lead to an interruption of the current flow through the electrical conductor, can be effectively prevented.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. An earth boring apparatus, comprising:

a drill rod having a hollow rod casing constructed for receiving a drill fluid from an external drill fluid source and for throughflow of the drill fluid;

an electrical conductor located within the rod casing; and an electrical voltage source connected to the rod casing and the conductor, said voltage source being connected such that in the event an exposed portion of the conductor is in contact with the drill fluid and the drill fluid is in contact with the rod casing, the conductor does not act as an anode with respect to the drill fluid, wherein the rod casing has a first layer, which comes into contact with the earth, and a second layer, which comes into contact with the drill fluid and is insulated relative to the first layer, wherein the second layer acts as an anode.

2. The earth boring apparatus of claim 1, wherein the voltage source supplies a voltage which is kept below a decomposition voltage of the drill fluid.

3. The earth boring apparatus of claim 1, wherein an electrical potential is established between the conductor and the rod casing in such a way that in the presence of the electrically conductive connection between the rod casing and the conductor, the conductor acts as cathode and the rod casing acts as anode.

4. The earth boring apparatus of claim 3, wherein a negative electrical potential is applied on the conductor in relation to the rod casing.

5. The earth boring apparatus of claim 3, wherein the voltage source is a negative direct voltage source, with the rod casing being grounded and connected to a plus pole of the negative direct voltage source, while the conductor is connected to a minus pole of the negative direct voltage source.

6. The earth boring apparatus of claim 1, wherein the voltage source is a positive direct voltage source, with the rod casing being connected to a plus pole, and the electrical conductor being connected to a minus pole of the positive direct voltage source.

7. The earth boring apparatus of claim 1, wherein the drill rod has a plurality of rod sections detachably connected to one another.

8. The earth boring apparatus of claim 7, wherein the conductor includes segments installed within the rod sections and connected to each other through couplings.

9. The earth boring apparatus of claim 8, wherein the segments are electrically insulated.

10. The earth boring apparatus of claim 8, wherein the segments are arranged fixed within the rod sections, and the couplings are constructed in such a way that a connection of the rod sections to each other leads to a simultaneous connection of the segments of the conductor.

11. A drill rod of an earth boring apparatus, comprising:

a hollow rod casing constructed for receiving a drill fluid from an external drill fluid source and for throughflow of the drill fluid;

an electrical conductor located within the rod casing and, when connected to an electrical voltage source, being prevented from acting as an anode with respect to the drill fluid in the event an exposed portion of the conductor is in contact with the drill fluid and the drill fluid is in contact with the rod casing, wherein the rod casing has a first layer, which comes into contact with the earth, and a second layer, which comes into contact with the drill fluid and is insulated relative to the first layer, wherein the second layer acts as an anode.

12. The drill rod of claim 11, wherein an electrical potential is established between the conductor and the rod casing in such a way that in the presence of the electrically conductive connection between the rod casing and the conductor, the conductor acts as cathode and the rod casing acts as anode.

13. The drill rod of claim 11, wherein a negative electrical potential is applied on the conductor in relation to the rod casing.

14. The drill rod of claim 11, wherein the rod casing is grounded and connected to a plus pole of a negative direct voltage source, while the conductor is connected to a minus pole of the negative direct voltage source.

15. The drill rod of claim 11, wherein the rod casing is connected to a plus pole of a positive direct voltage source, and the electrical conductor is connected to a minus pole of the positive direct voltage source.

16. The drill rod of claim 11, wherein the drill rod has a plurality of rod sections detachably connected to one another.

17. The drill rod of claim 16, wherein the conductor includes segments installed within the rod sections and connected to each other through couplings.

18. The drill rod of claim 17, wherein the segments are electrically insulated.

19. The drill rod of claim 17, wherein the segments are arranged fixed within the rod sections, and the couplings are constructed in such a way that a connection of the rod sections to each other leads to a simultaneous connection of the segments of the conductor.

* * * * *